US005791931A

United States Patent [19]

Burkhart, Sr.

[11] Patent Number: 5,791,931

[45] Date of Patent: Aug. 11, 1998

[54] LOCKING ELECTRICAL OUTLET

[76] Inventor: Steven Andrew Burkhart, Sr., P.O. Box 532, Spring Arbor, Mich. 49283

[21] Appl. No.: 697,892

[22] Filed: Sep. 3, 1996

Related U.S. Application Data

[63] Continuation-in-part of Ser. No. 378,014, Jan. 25, 1995, Pat. No. 5,551,884.

[51] Int. Cl.[6] ..... H01R 4/50; H01R 13/625

[52] U.S. Cl. ..... 439/346; 439/304

[58] Field of Search ..... 439/346, 102, 439/263, 304

[56] References Cited

U.S. PATENT DOCUMENTS

| | | | |
|---|---|---|---|
| 3,350,675 | 10/1967 | Misencik et al. . | |
| 3,543,218 | 11/1970 | Archer . | |
| 3,805,211 | 4/1974 | Moore . | |
| 4,061,409 | 12/1977 | Bealmear . | |
| 4,085,991 | 4/1978 | Marshall et al. . | |
| 4,136,919 | 1/1979 | Howard et al. . | |
| 4,167,658 | 9/1979 | Sherman . | |
| 4,530,556 | 7/1985 | Bonus . | |
| 4,846,707 | 7/1989 | Pirkle . | |
| 4,909,749 | 3/1990 | Long . | |
| 4,925,396 | 5/1990 | Grover | 439/346 |
| 4,969,833 | 11/1990 | Lindow et al. . | |
| 5,082,450 | 1/1992 | Warren, Sr. et al. | 439/346 |
| 5,129,836 | 7/1992 | Ursich . | |
| 5,197,897 | 3/1993 | Torok | 439/263 |
| 5,286,213 | 2/1994 | Altergott et al. . | |
| 5,551,884 | 9/1996 | Burkhart, Sr. | 439/346 |

*Primary Examiner*—Neil Abrams
*Assistant Examiner*—Katrina Davis
*Attorney, Agent, or Firm*—Richard C. Litman

[57] ABSTRACT

A lockable electrical socket has a grasping jaw which can pivot relative to a conductive contact in response to the translational motion of a carrier supporting the grasping jaw in order to selectively retain an electrical plug in place. The plug can be released by pushing in the plug and then allowing the plug retaining assembly and the plug to be thrust out under spring pressure. In a second embodiment a key is required to allow the plug to be released in order to prevent unauthorized removal of the plug from the socket. A dummy or safety plug can be used in place of an electrical plug to make the lockable socket child-proof.

12 Claims, 10 Drawing Sheets

LOCKING ELECTRICAL OUTLET

CROSS-REFERENCE TO RELATED APPLICATIONS

This application is a continuation-in-part (CIP) of application Ser. No. 08/378,014, filed Jan. 25, 1995 now U.S. Pat. No. 5,551,884.

BACKGROUND OF THE INVENTION

1. Field of the Invention

The present invention relates to electrical sockets having releasable locking mechanisms to lock the contact prongs of electrical plugs in the socket.

2. Description of the Prior Art

Typical household electrical sockets normally include an insulated housing having two or three openings for receiving the prongs of an electrical plug. Such electrical sockets suffer many draw backs. For example, as the socket wears, the plug is no longer tightly retained in the socket. The plug may then partially slip out of the socket either due to gravity or minor tugs on the plug cord. If the plug is grasped in this condition a risk of electrical shock exists because of the partially exposed prongs. Also the exposed prongs may present a fire hazard.

In addition, conventional sockets present an annoying inconvenience to users who repeatedly have to reinsert inadvertently disconnected plugs.

Further, children are extremely fascinated with electrical outlets, and have a tendency to remove electrical plugs from their outlets and insert objects such as paper clips or other metallic items into the outlet, thus subjecting themselves to the risk of electric shock.

For the aforementioned reasons, many electrical sockets that releasably lock the electrical plug in the socket, have been proposed in the prior art. The following United States patents all show releasably locking electrical sockets.

| U.S. Pat. No. | Name |
|---|---|
| 5,286,213 | Altergott et al. |
| 5,129,836 | Ursich |
| 4,969,833 | Lindow et al. |
| 4,909,749 | Long |
| 4,846,707 | Pirkle |
| 4,530,556 | Bonus |
| 4,167,658 | Sherman |
| 4,136,919 | Howard et al. |
| 4,085,991 | Marshall et al. |
| 4,061,409 | Bealmear |
| 3,805,211 | Moore |
| 3,543,218 | Archer |
| 3,350,675 | Misencik et al. |

However, none of the cited references teach or suggest a pivoting jaw which hooks to the prong of a plug, with the jaw being mounted to a carrier capable of receiving the plug prongs and of reciprocating movement within a housing.

None of the above inventions and patents, taken either singly or in combination, is seen to describe the instant invention as claimed.

SUMMARY OF THE INVENTION

The present invention is directed to a lockable electrical socket that has at least one pivoting jaw that is mounted in a movable carrier. The carrier has openings for the prongs of the plug. The carrier is slidably supported in a housing. A pair of resilient conductive contacts are fixed relative to the housing and project into the interior of the carrier. Cuts made in the carrier allow the carrier to move relative to the conductive contacts. As the carrier moves to the locked position, the pivoting jaw is cammed into a position where the pivoting jaw hooks the plug's prong inserted into the carrier. Once the carrier is locked in place the plug will be retained in the socket. The plug can be released by pushing in the carrier by pushing in on the plug, and then allowing the carrier and the plug to be thrust out of the housing under spring pressure.

Accordingly, it is a principal object of the invention to provide an electrical socket that releasably locks electrical plugs in place.

It is another object of the invention to provide a lockable electrical socket which can be locked and unlocked by simply pushing in the plug.

It is a further object of the invention to provide a lockable electrical socket which can be unlocked by a key to prevent unauthorized access thereto.

Still another object of the invention is to provide a socket that can releasably retain a dummy plug to prevent children from inserting metal objects therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Referring to FIGS. 1A, 1B, 2, 3, 4A, 4B, and 9, the present invention is directed to an electrical outlet or socket which releasably locks a plug 10 in place after the plug is inserted into the socket. In the following description the principles of the present invention are discussed in the context of a twin or dual socket in which two sockets or receptacles are provided in the same opening formed in the interior wall of a building structure. However, the basic principles of the present invention are equally applicable to a single socket or a socket at the end of an extension cord.

Figure 1A:
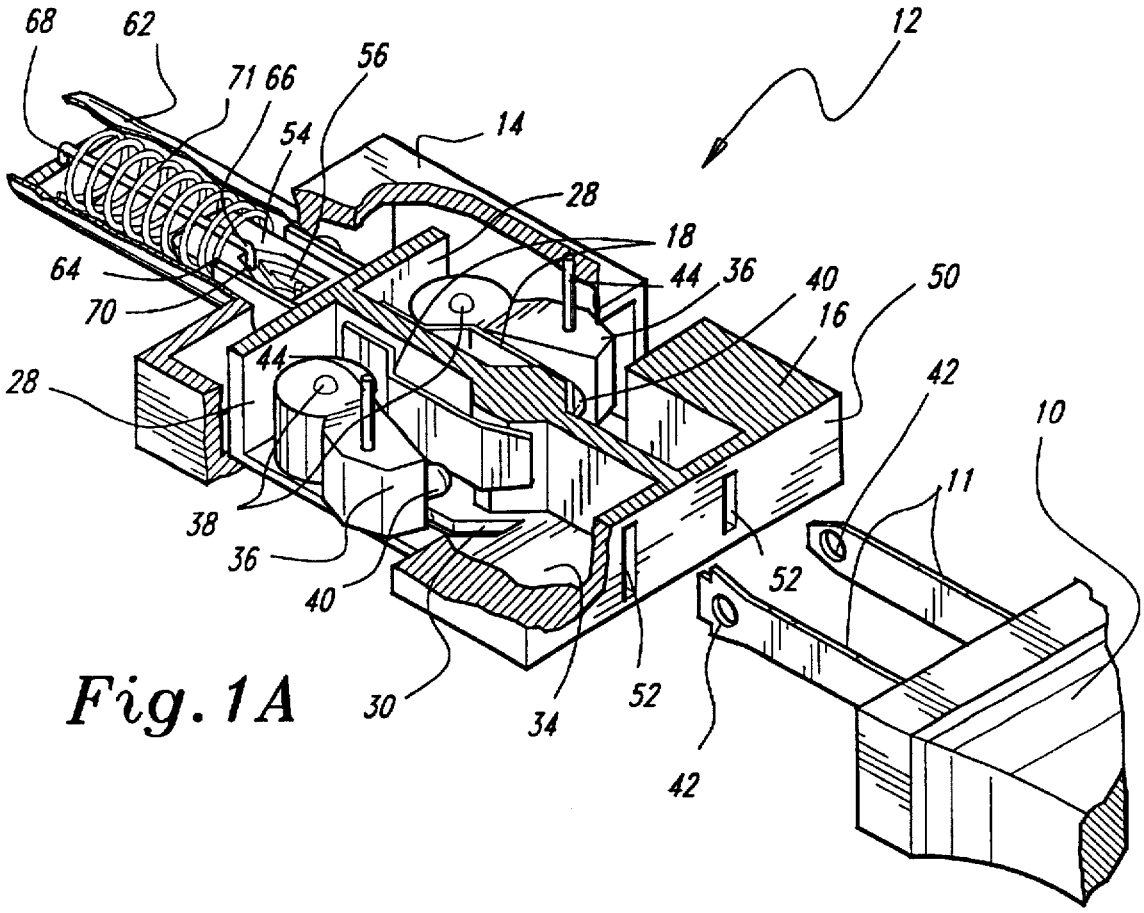
FIG. 1A is a cutaway perspective view of the locking socket of the present invention in the unlocked position.
Figure 1B:
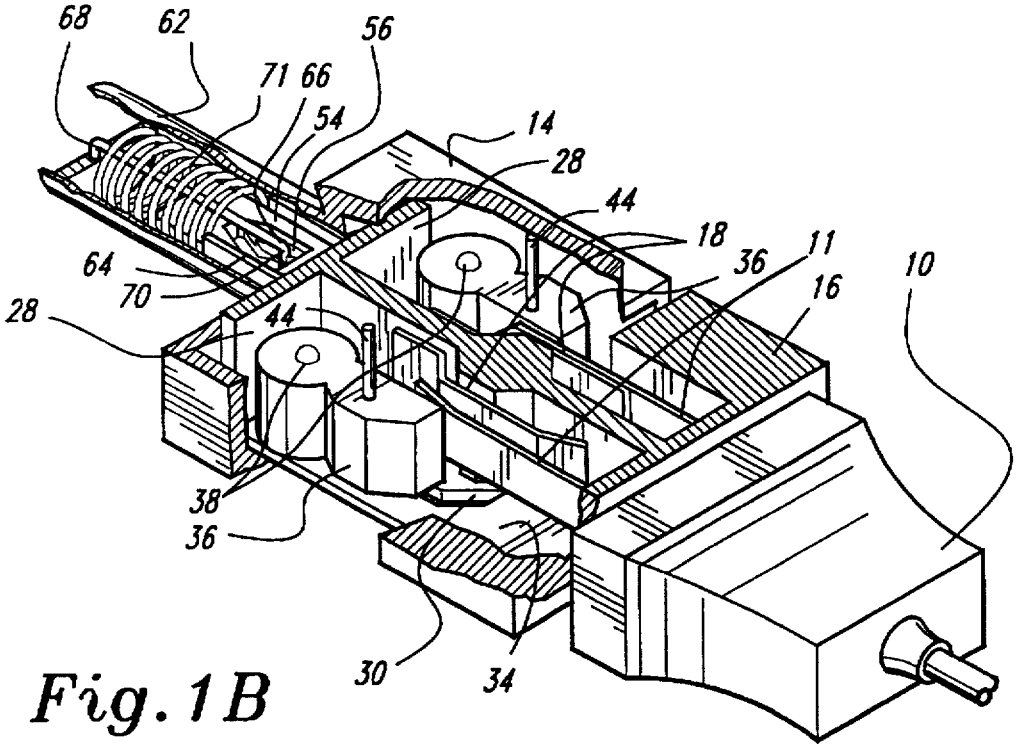
FIG. 1B is a cutaway perspective view of the locking socket of the present invention in the locked position.

A socket in accordance to the invention is illustrated by the top socket 12 shown in FIGS. 1A and 1B. The socket 12 includes a housing 14, a sliding carrier 16, and conductive contacts 18. The conductive contacts 18 are fixed, i.e. do not move, relative to the housing 14 once the socket 12 is operational, i.e. when the socket 12 forms part of a fully assembled locking electrical outlet made in accordance to the present invention.

Figure 2:
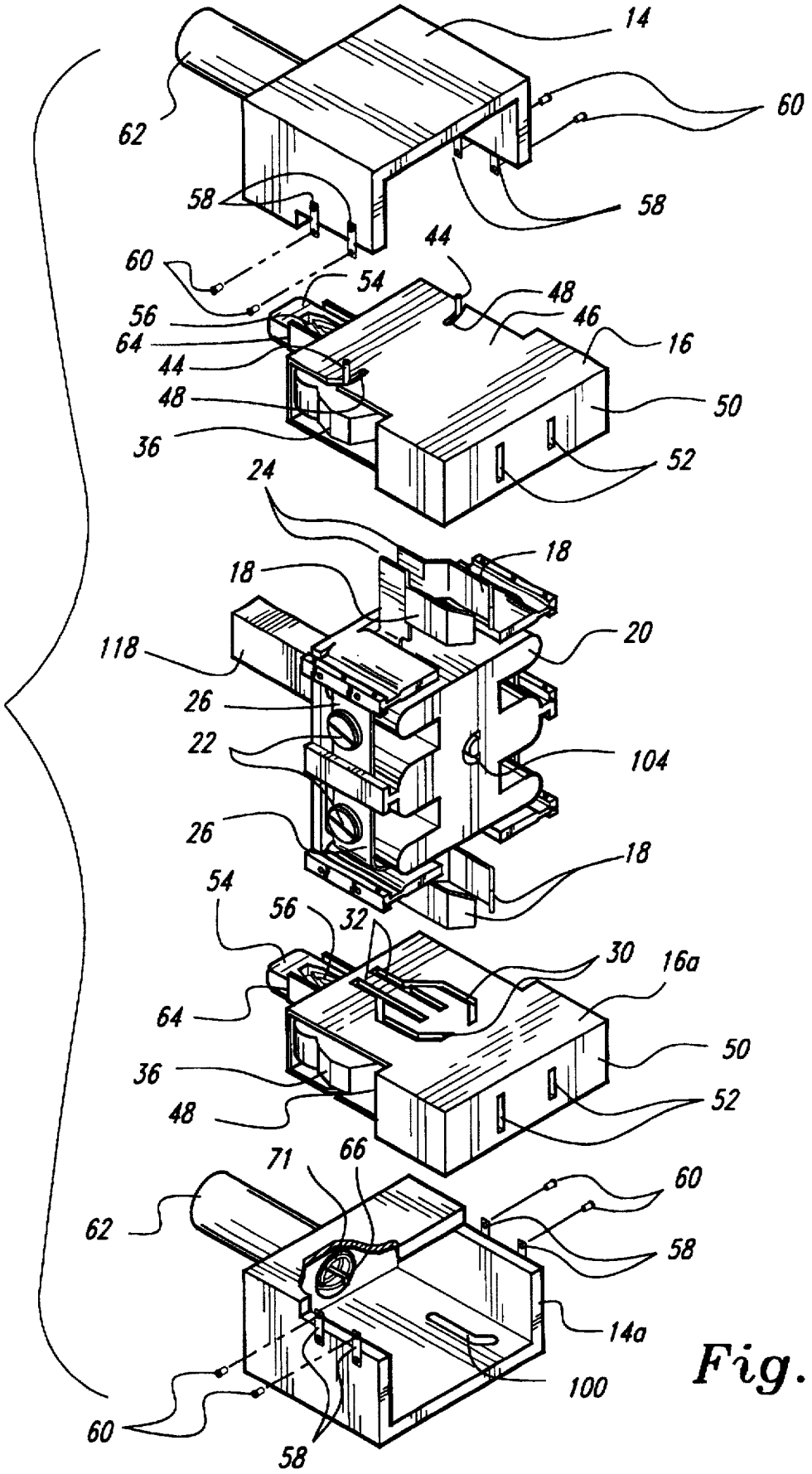
FIG. 2 is an exploded view of a dual locking socket using the locking socket of the present invention for plugs of the two prong type.
Figure 3:
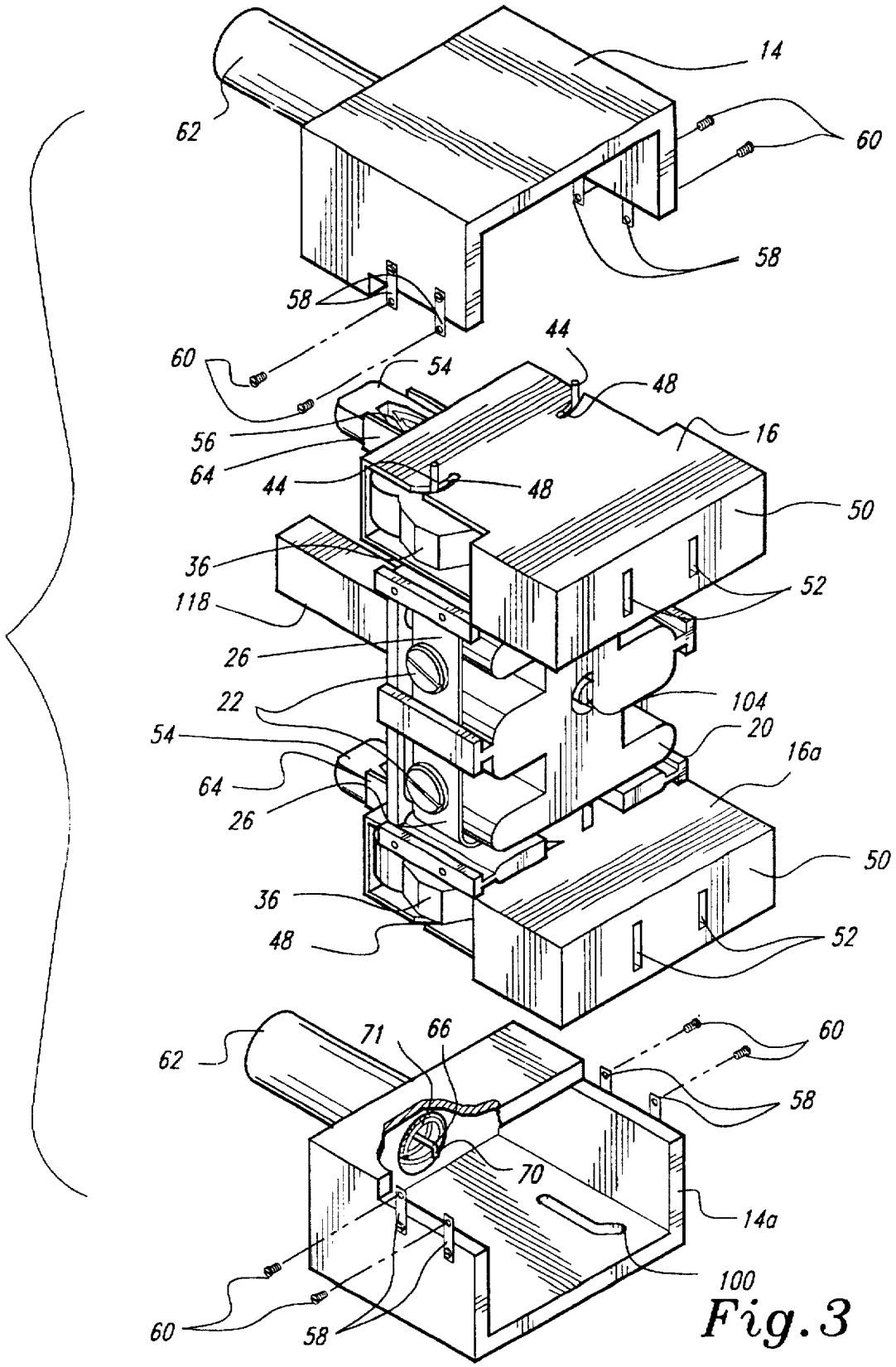
FIG. 3 is a perspective view of a dual locking socket using the locking socket of the present invention for plugs of the two prong type with the carrier housings removed.

Referring to FIGS. 2 and 3, the conductive contacts 18 are fixed to a base 20. Screws 22 allow the building wiring to be connected to the conductive contacts 18. The conductive contacts 18 are bowed outward relative to the centerline of the base 20 when viewed from above. Being bowed outward allows the conductive contacts 18 to frictionally engage the prongs 11 of the plug 10 once they are inserted into the socket. Each of the contacts 18 also has a vertical portion 24 which supports the bowed out portion at some distance above the top of the base 20. Also the vertical portions 24 are conductively connected to the conductive strips 26 which support the screws 22.

Referring again to FIGS. 1A and 1B, the carrier 16 has an internal cavity 28 which need not be partitioned into two portions as in the illustrated example. On the bottom of the carrier 16 are slots 30 which follow the outline of the bowed out portion of the contacts 18 (also see FIG. 2). The slots 30 communicate with the cavity 28 and are dimensioned to allow the contacts 18 to pass into the cavity 28. Referring to FIG. 2, the slots 30 merge with slots 32 (the carrier 16 has slots identical to the slots 32 shown for the carrier 16*a*). The slots 32 are dimensioned and configured to allow the vertical portions 24 of the contacts 18 to pass into the cavity 28. The length of the slots 32 is chosen such that the carrier 16 can slidably move relative to the base 20 without interference from the vertical portions 24 of the contacts 18, which are fixed relative to the base 20.

With the carrier 16 in sliding contact with the base 20, The contacts 18 will be positioned inside the cavity 28 as shown in FIGS. 1A and 1B. Because the vertical portions 24 support the contacts 18 at a predetermined height above the floor 34 of the cavity 28, the contacts 18 will not interfere with the sliding movement of the carrier 16 relative to the base 20.

The carrier 16 has a pair of pivoting jaws 36 that are pivotably supported within the cavity 28 by pivot pins 38. Each jaw 36 has a projection 40 intended to engage holes 42 in the prongs 11 when the plug 10 is in the locked position. The projections 40 project from the side of the jaws 36 that face the contacts 18. The jaws 36 also have guide rods 44 which project vertically from each jaw 36. As shown in FIGS. 2 and 3, the guide rods 44 pass through the roof 46 of the carrier 16. Arcuate slots 48 formed in the roof 46 of the carrier 16 allow the jaws 36 to pivot without the guide rods 44 and the roof 46 interfering with one another. The front face 50 of the carrier 16 has openings 52 for receiving the prongs 11 of the plug 10. A platform 54 projects from the rear of the carrier 16, and is preferably of one-piece construction with the carrier 16. A guide track 56 is formed in the top surface of the platform 54. The function of the guide track 56 will be discussed later herein.

The housing 14 is mounted to the base 20 by the plates 58 and the fasteners 60, after the carrier 16 is positioned in sliding contact with the base 20 with the contacts 18 positioned inside the cavity 28. Note that many other well known methods may also be used to fix the housing 14 to the base 20, instead of using the plates 58 and fasteners 60. The housing 14 surrounds at least a portion of the carrier 16 at all times. With the housing 14 fixed to the base 20, the carrier 16 can move reciprocatingly relative to the housing 14 such that the length of the portion of the carrier 16 lying within the housing 14 can vary as a result of such movement.

Fixed to the rear of the housing 14 is a spring housing 62. The spring housing 62 is in the form of a tube having a closed end and an open end. The open end of the spring housing 62 is attached to the housing 14 and the interior of the spring housing 62 is in communication with the interior of the housing 14. With the carrier 16 properly positioned in the housing 14 and the housing 14 fixed to the base 20, the platform 54 will be in registry with the interior of the spring housing 62 and will lie at least in part within the spring housing 62 at all times. When the carrier 16 moves reciprocatingly relative to the housing 14, the length of the portion of the platform 54 lying within the spring housing 62 can vary as a result of such movement. A shoulder 64 partially surrounds the platform 54 and is integral with the platform 54 and the carrier 16. The shoulder 64 can also pass into the interior of the spring housing 62.

A guide pin 66 is housed within the spring housing 62. The guide pin 66 has an elongated middle portion with two relatively short transverse portions 68 and 70 at either end; the transverse portions 68 and 70 being perpendicular to the longitudinal axis of the elongated portion of the guide pin 66. The transverse portion 68 of the guide pin 66 is embedded in the closed end of the spring housing 62. The transverse portion 70 of the guide pin 66 engages the guide track 56. As the carrier 16 reciprocatingly moves relative to the housing 14, the transverse portion 70 of the guide pin 66 follows the guide track 56. As the transverse portion 70 follows the guide track 56, the transverse portion 70 will move in an arc with a center of curvature at the transverse portion 68. If the elongated portion of the guide pin 66 is sufficiently resilient, then the transverse portion 68 can be fixedly embedded in the closed end of the spring housing 62. Alternatively, the transverse portion 68 may be free to rotate about its longitudinal axis such that the transverse portion 70 is free to move along the arc centered at the transverse portion 68, as the transverse portion 70 is moved in response to the reciprocating movement of the guide track 56. Because the transverse portion 68 is embedded in the closed end of the spring housing 62, the transverse portion 68 can not deviate from its original orientation within the closed end of the spring housing 62. Therefore, when the transverse portion 70 is moved vertically upward, the elongated portion of the guide pin 66 will have to bend or flex. With the transverse portion 70 initially positioned to contact the deepest point of the guide track 56, the resilience of the elongated portion of the guide pin 66 will bias the transverse portion 70 toward continuous contact with the bottom surface of the guide track 56. Thus, the transverse portion 70 will follow the bottom surface of the guide track 56, i.e. the vertical position of the transverse portion 70 will be a function of the depth of the portion of the bottom of the guide track 56 immediately under the transverse portion 70, as the carrier 16 reciprocatingly moves relative to the housing 14.

Also housed within the spring housing 62 is a coil spring 71. The coil spring 71 extends between the shoulder 64 and the closed end of the spring housing 62, and the coil spring 71 surrounds the guide pin 66. The coil spring 71 biases the carrier 16 toward the forwardmost or open position.

Figure 4A:
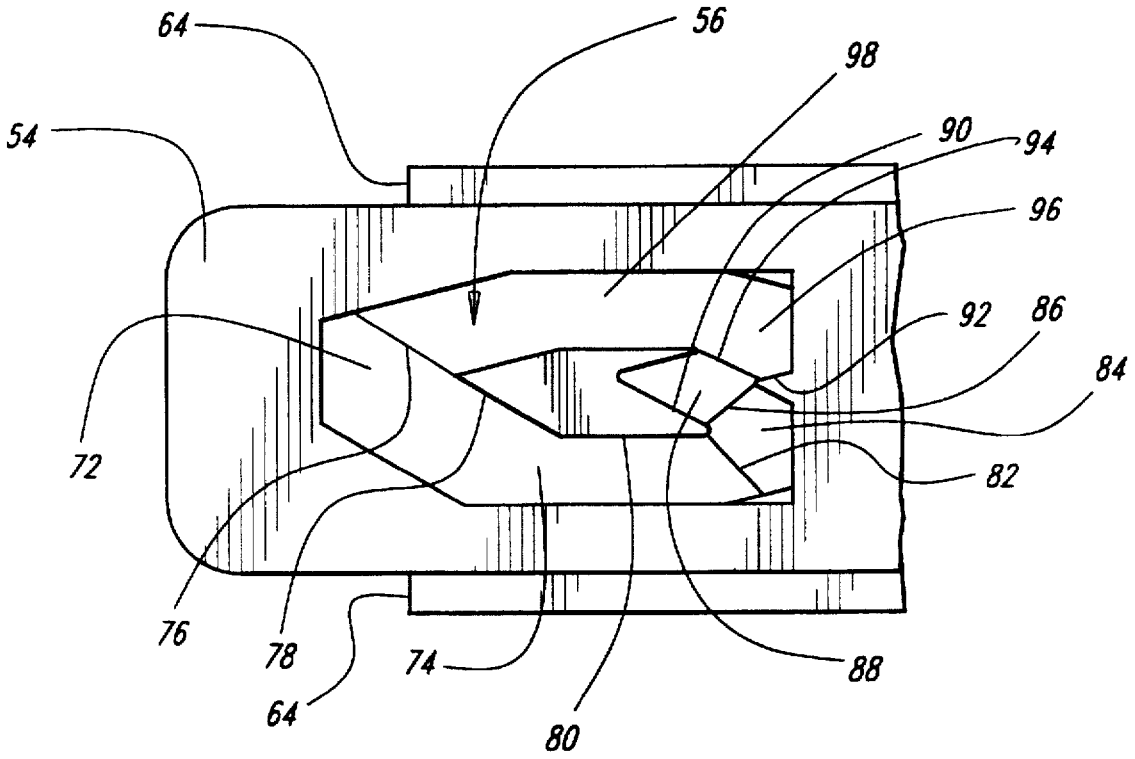
FIG. 4A is a top view of the extension projecting from the rear of the carrier showing the guide track for the guide pin of the locking mechanism.
Figure 4B:
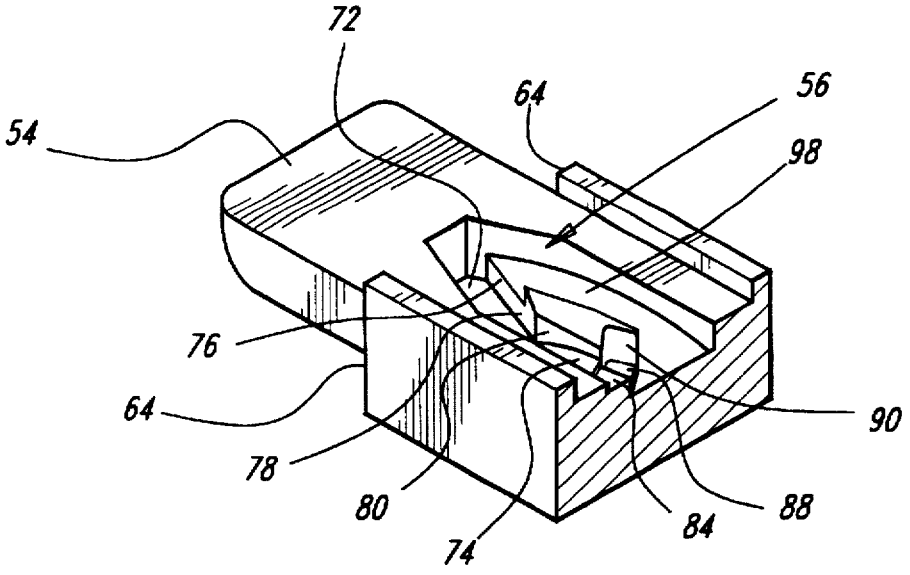
FIG. 4B is a fragmentary perspective view of the extension projecting from the rear of the carrier showing the guide track for the guide pin of the locking mechanism.

The guide track 56 is shown in greater detail in FIGS. 4A and 4B. When the carrier 16 is in the fully forward or open position the transverse portion 70 of the guide pin 66 will be in contact with the bottom 72 of the ramp 74. As the carrier 16 is pushed into the housing 14, the transverse portion 70 is forced up the ramp 74 guided by the vertical surfaces 76, 78, and 80. As the carrier 16 reaches its rearmost position, the transverse portion 70 snaps over the vertical surface 82 and contacts the step 84. Once the carrier 16 is released, the carrier will move forward under the impetus provided by the coil spring 71. Guided by the vertical surface 82, the transverse portion 70 of the guide pin 66 snaps over the vertical surface 86 and contacts the step 88. The carrier 16 will continue to move forward until the transverse portion 70 becomes trapped by the V-shaped surface 90. Thus, the carrier 16 will be held in the locked position, the locked position being intermediate the rearmost and the forwardmost positions.

To release the carrier 16, the carrier 16 is again pushed to the rear until the carrier again reaches the rearmost position. During this rearward movement the transverse portion 70, guided by the vertical surface 86 and the wedge 92, snaps over the vertical surface 94 and contacts the bottom 96 of the ramp 98. Releasing the carrier 16 then allows the spring 71 to force the carrier 16 toward the unlocked or forwardmost position. During the forward movement of the carrier 16 toward the unlocked position, the transverse portion 70 is forced up the ramp 98. As the carrier 16 nears the unlocked position, the transverse portion 70 snaps over the vertical surface 76 once again becoming positioned at the bottom 72 of the ramp 74. Once positioned at the bottom 72 of the ramp 74, the transverse portion 70 prevents further forward movement of the carrier 16 thus maintaining the carrier 16 in the unlocked position.

Figure 9:
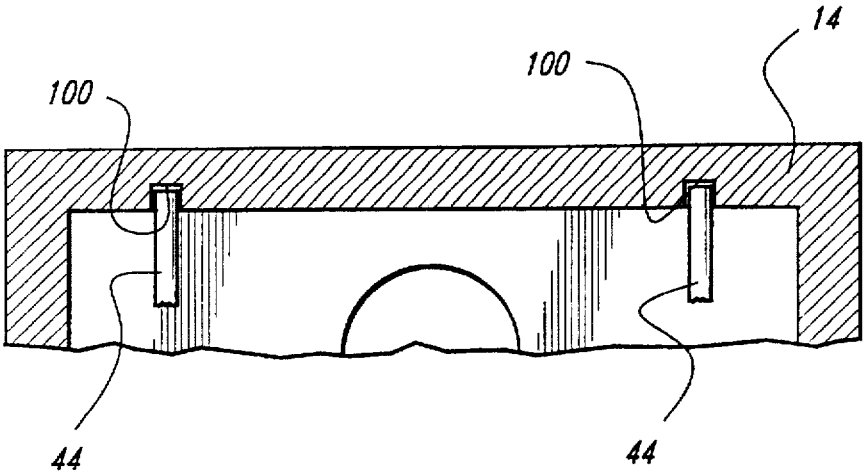
FIG. 9 is a fragmentary view showing the cam tracks in the carrier housing.

The guide rods 44 ride in respective guide grooves 100, which are provided on the underside of the roof of the housing 14 (see FIGS. 2, 3, and 9, the guide grooves of the housing 14 being identical to the guide grooves 100 shown for the housing 14*a*). The guide grooves 100 act to keep the jaws 36 away from the contacts 18 when the carrier 16 is in the unlocked position, thus keeping the jaws 36 ready for receiving each prong 11 of the plug 10 between a respective jaw 36 and a respective contact 18.

The conductive contacts 18 will conductively connect the prongs 11 of the plug 10 to the building's wiring when the plug 10 is inserted in the socket and the carrier 16 is in the locked position. The jaws 36 may or may not be made of conductive materials. The carrier 16 must be made of non-conductive materials such as plastic to prevent short circuits between the contacts 18. All materials used in the socket of the present invention should be chosen such that short circuits between the contacts 18 and between the prongs 11 of the plug 10 are prevented.

To illustrate the operation of the socket of the present invention, consider the socket to be initially in the unlocked configuration shown in FIG. 1A. In the unlocked state the carrier 16 is fully forward in the unlocked position illustrated in FIG. 1A. The guide rods 44 keep the jaws 36 open by virtue of their position along guide grooves 100. Coil spring 71 urges the carrier 16 forward, and the transverse portion 70 engages the bottom 72 of the ramp 74 of the guide track 56.

When a plug 10 is being inserted in the socket, the prongs 11 pass through the corresponding openings 52 in the carrier 16 until the face of plug 10 abuts against the face 50 of the carrier 16. As the plug 10 is pushed in further, the prongs 11 frictionally engage the contacts 18 and the carrier 16 begins to move rearward. Simultaneously, the rearward movement of the carrier 16 and the platform 54 compresses the coil spring 71.

Also, as the carrier 16 moves to the rear, the transverse portion 70 of the guide pin 66 engaging the guide track 56 is forced to the side and upward within the guide track 56 by the ramp 74 and the vertical surfaces 76, 78, and 80. The guide pin 66 is sufficiently resilient to allow the transverse portion 70 to follow the camming profile of the guide track 56. In addition, rearward movement of the carrier 16 causes the jaws 36 to pivot toward the contacts 18 under the influence of guide rods 44 riding in the guide grooves 100. As the carrier 16 moves toward the limit of its rearward travel, the guide grooves 100 cause the prongs 11 to be tightly grasped by the jaws 36 and the contacts 18, with the projections 40 engaging the holes 42.

When the carrier 16 nears the limit of its rearward travel, the transverse portion 70 of the guide pin 66 engaging guide track 56 snaps over the vertical surface 82 and contacts the step 84. When pressure on plug 10 is released, the carrier 16 moves forward under the thrust provided by coil spring 71. This forward movement is limited and is not sufficient to disengage jaws 36 from the prongs 11. During this limited forward motion, the transverse portion 70 of the guide pin 66 becomes trapped by the V-shaped surface 90. In this position the transverse portion 70 of the guide pin 66 acts as a stop preventing further forward movement of the carrier 16 and thus maintaining the carrier 16 in the locked position.

To unlock the socket and remove the plug 10, the plug is first pushed in to move the transverse portion 70 of the guide pin 66 out of the point of the V-shaped surface 90 of the guide track 56. As the carrier 16 reaches the limit of its rearward motion, the transverse portion 70 snaps over the vertical surface 94 and becomes positioned on the bottom 96 of the ramp 98. When pressure on the plug 10 is released, the carrier 16 moves forward under the influence of coil spring 71. During this forward motion, the transverse portion 70 of guide pin 66 is in continuous contact with ramp 98 and allows the carrier 16 to move to its fully forward position. Also during this forward motion, the guide grooves 100 acting on guide rods 44, urge the jaws 36 away from the contacts 18 thus releasing plug 10. At the end of this forward motion the transverse portion 70 of the guide pin 66 snaps over the vertical wall 76 and comes to rest at the bottom 72 of ramp 74 of the guide track 56. With the transverse portion 70 in this position the carrier 16 is in the unlocked position and the plug 10 can be removed.

Referring to FIGS. 2 and 3 the dual socket employing the locking sockets of the present invention can be seen. In addition to the top socket discussed above, the dual socket has a substantially identical bottom socket which is vertically spaced from the top locking socket. The base 20 has a second pair of conductive contacts 18 which are oriented upside down relative to the contacts 18 of the top socket. The bottom socket has a housing 14*a* which is identical to the housing 14 except that, the housing 14*a* is oriented upside down relative to the housing 14, while the spring housing 62, the coil spring 71, and the guide pin 66 are oriented the same as those of the top socket. In addition, the bottom socket has a carrier 16*a* which is identical to the carrier 16 except that essentially the entire carrier 16*a* along with the jaws 36, the guide rods 44, the slots 48, the slots 30, and the slots 32 are oriented upside down relative to the carrier 16, while the face 50, the openings 52, and the platform 54 are oriented the same as those for the top socket. Otherwise the bottom socket is identical, in structure, function, and operation, to the top socket described above.

Figure 5:
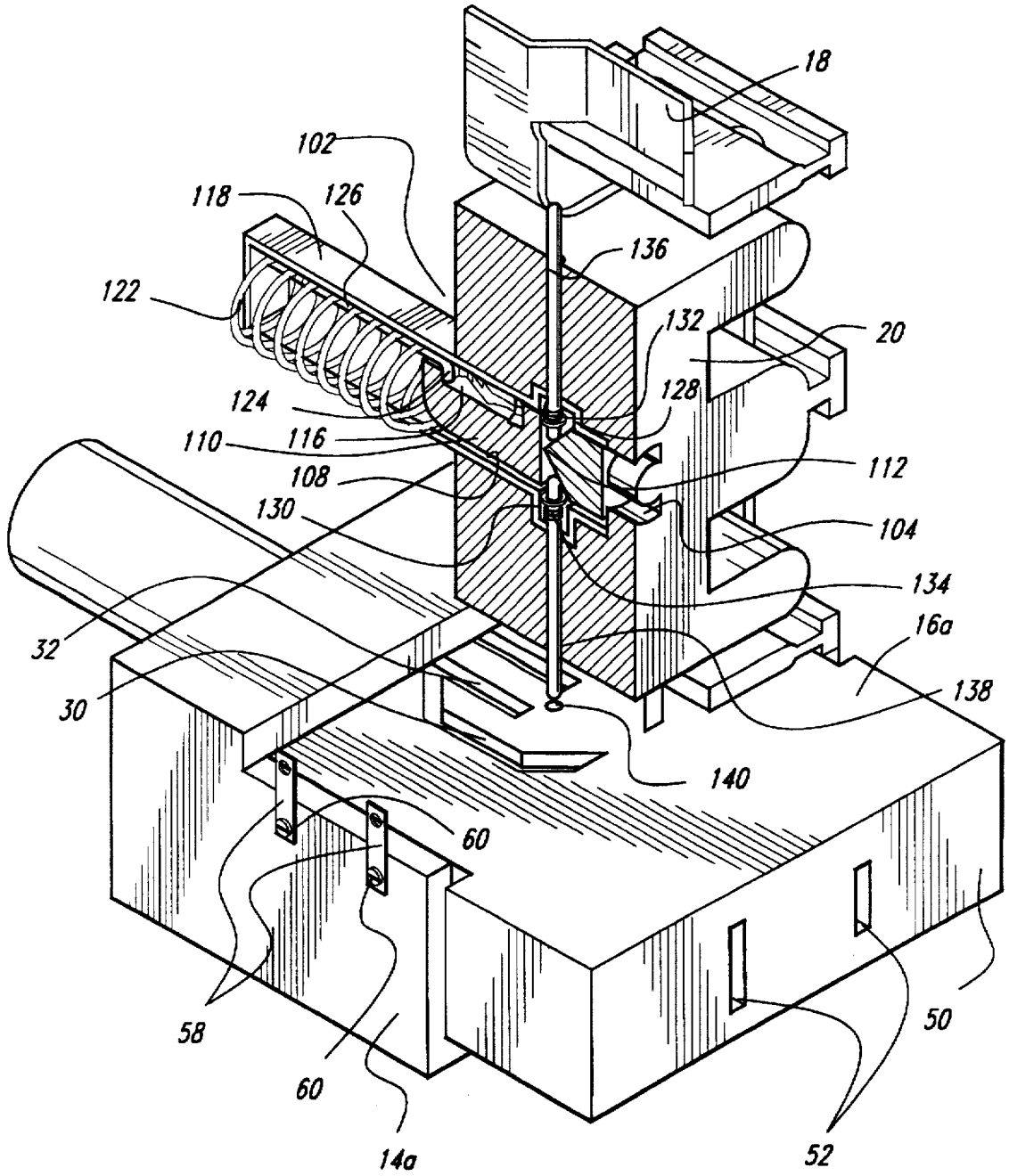
FIG. 5 is a cutaway perspective view of the dual locking socket of the present invention showing details of the key operated lock.
Figure 6:
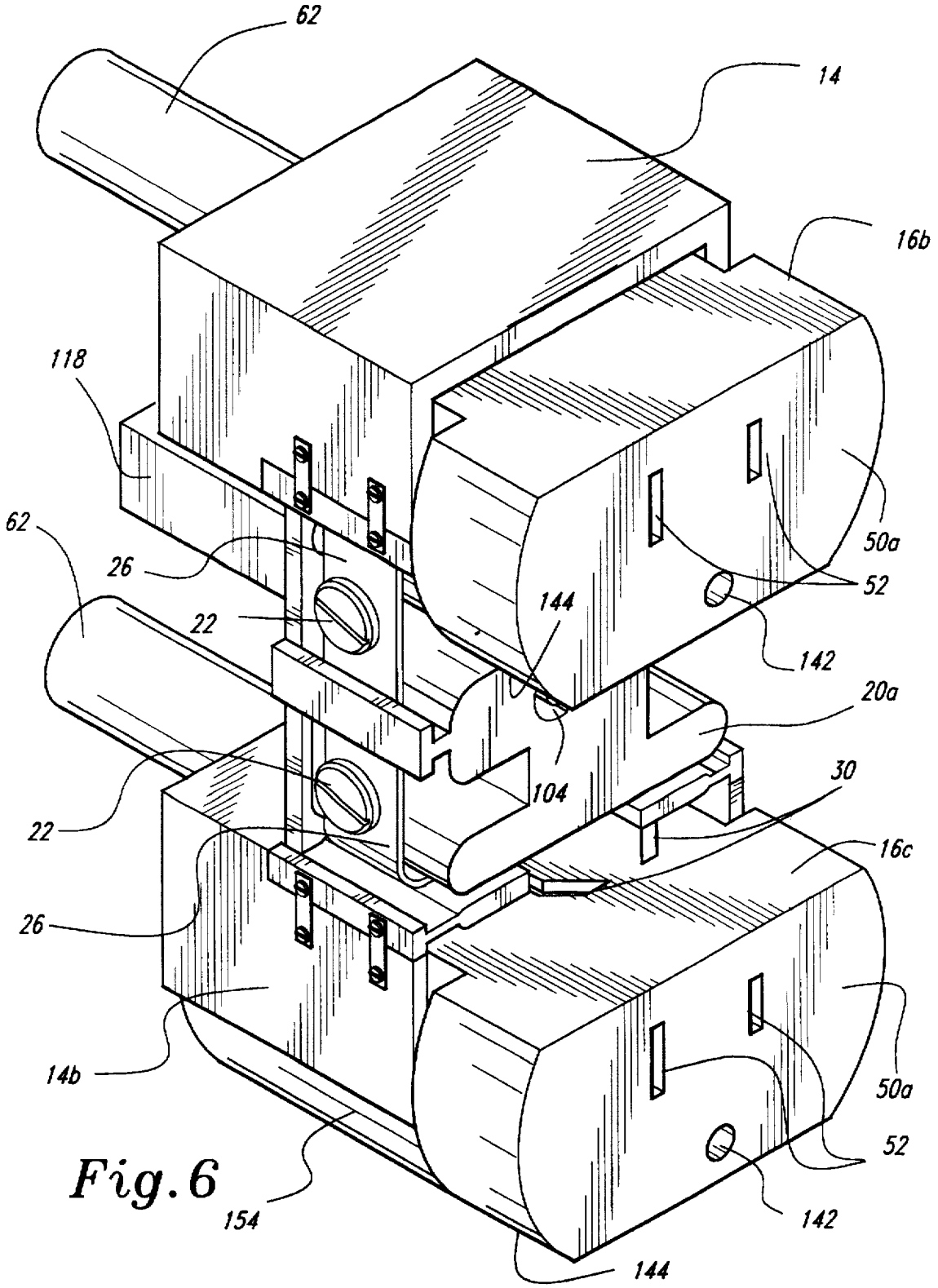
FIG. 6 is a perspective view of a dual locking socket using the locking socket of the present invention for plugs of the three prong type.
Figure 7:
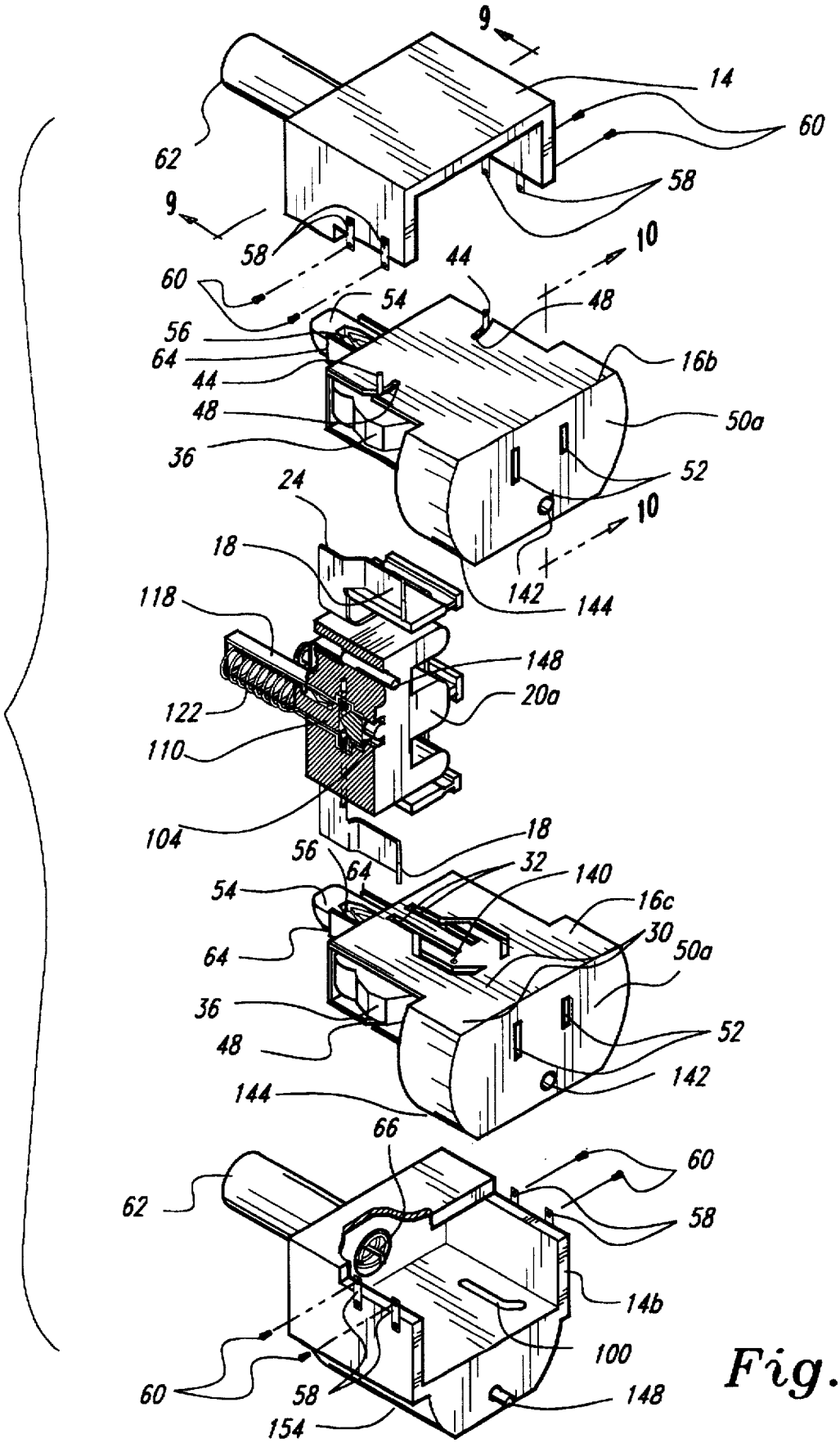
FIG. 7 is a partially cutaway exploded view of a dual locking socket using the locking socket of the present invention for plugs of the three prong type.
Figure 8:
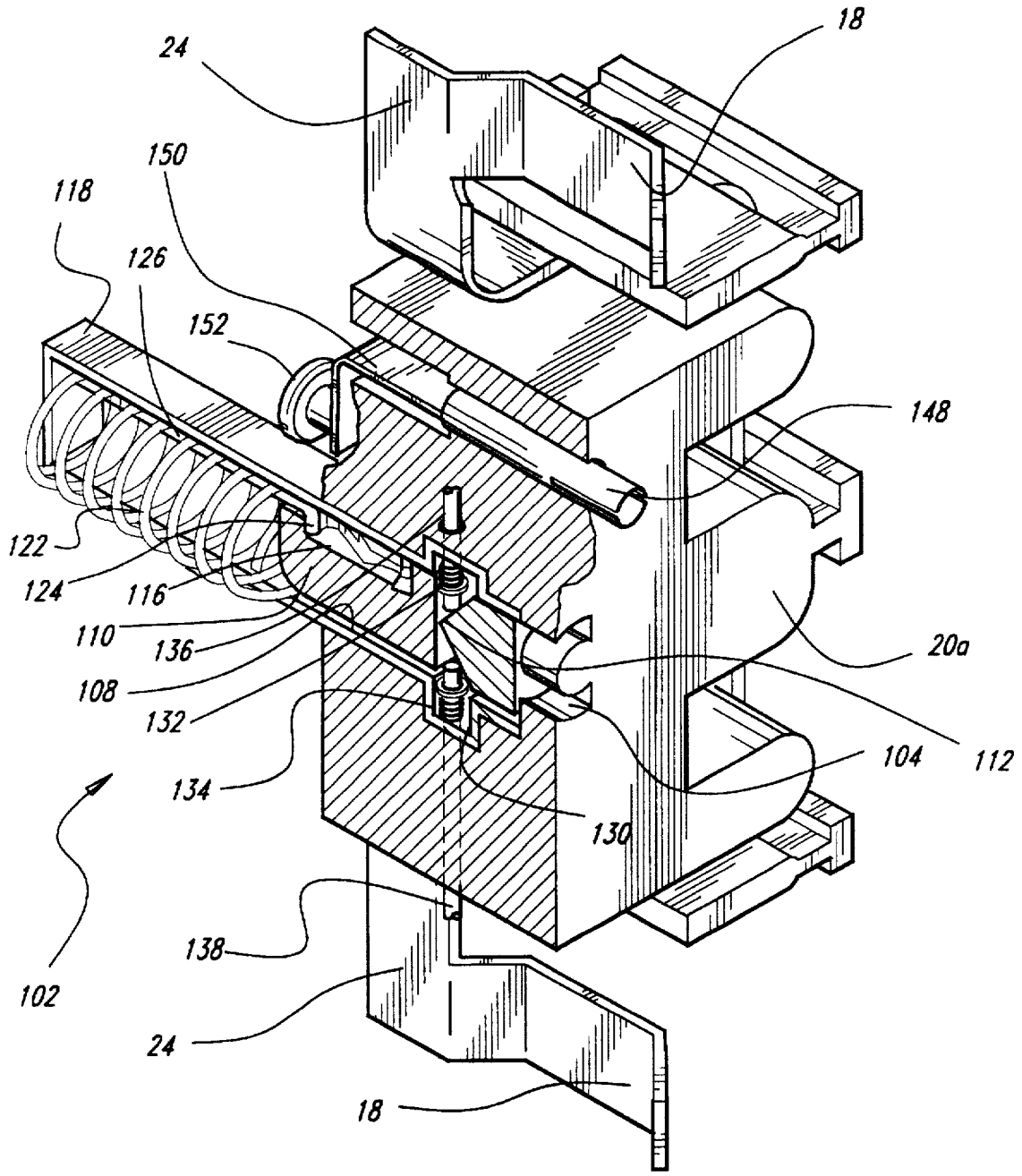
FIG. 8 is a cutaway perspective view of the dual locking socket of the present invention showing details of the key operated lock and the ground contact for plugs of the three prong type.
Figure 11:
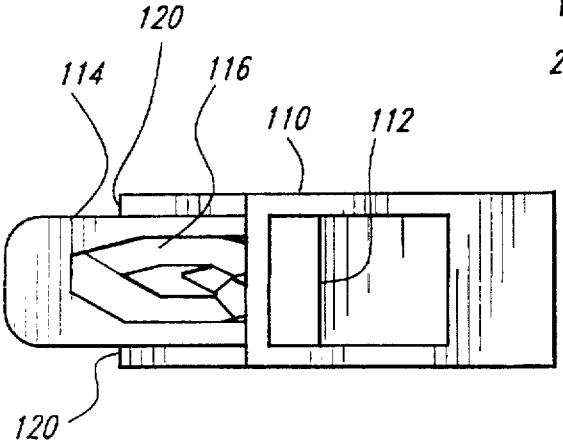
FIG. 11 is a top view of the wedge carrier of the key operated lock of the present invention.
Figure 13:
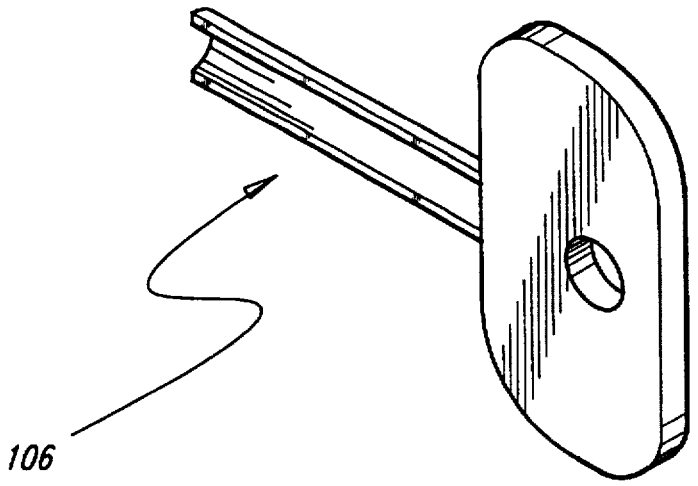
FIG. 13 is perspective view of a key usable with the key operated lock of the present invention.

Referring to FIGS. 5, 11, and 13, a key lock 102 is provided between the top and bottom locking sockets. The key lock 102 includes a C-shaped keyhole 104 which allows only the key 106, which has a matchingly shaped cross section, to be inserted therein. The keyhole 104 is in communication with a cavity 108. The cavity 108 houses a wedge carrier 110. The wedge carrier 110 carries a wedge 112, and has a platform 114 and a guide track 116 which function in the same manner as the platform 54 and the guide track 56 discussed previously.

A spring housing 118, similar in structure to spring guide 62, is provided at the rear of the cavity 108. The spring housing 118 is in communication with the cavity 108 such that the platform 114 lies at least in part in the spring housing 118 at all times. When the wedge carrier 110 moves reciprocatingly relative to the cavity 108, the length of the portion of the platform 114 lying within the spring housing 118 will vary as a result of such movement. A shoulder 120 partially surrounds the platform 114 and is integral with the platform 114 and the wedge carrier 110. The shoulder 120 can also pass into the interior of the spring housing 118. The spring housing 118 houses a coil spring 122. The coil spring 122 extends between the closed end of the spring housing 118 and the shoulder 120, and biases the wedge carrier 110 toward the keyhole 104. The guide track 116 is engaged by a transverse portion 124 of a guide pin 126 which function in exactly the same manner as described previously in reference to the transverse portion 70 and the guide pin 66.

Provided on the top and bottom of the cavity 108 are locking pin spring housings 128 and 130. Each of the locking pin spring housings 128 and 130 are open to the interior of the cavity 108 at one end. The housings 128 and 130 house springs 132 and 134 respectively. The springs 132 and 134 surround locking pins 136 and 138 respectively. The spring 132 extends between the end wall of the housing 128 and a flange or washer fixed to the locking pin 136. The spring 134 extends between the end wall of the housing 130 and a flange or washer fixed to the locking pin 138. The springs 132 and 134 bias the locking pins 136 and 138 respectively toward the interior of the cavity 108. Channels in the base 20 allow the locking pins 136 and 138 to pass through the base 20 so as to reach the vicinity of the carriers 16 and 16*a* respectively. The locking pins 136 and 138 register with holes 140 provided in each of the carriers 16 and 16*a* (only one shown), when the carriers 16 and 16*a* are in the locked position.

In the same manner as described with regard to carrier 16, the wedge carrier 110 can be moved into the locking position by pushing the wedge carrier 110 in with the key 106. Once the wedge carrier 110 reaches its rearmost position, releasing the key 106 allows the wedge carrier 110 to move slightly forward under the influence of coil spring 122, to trap the transverse portion 124 in the forward V-shaped surface (similar to surface 90) of the guide track 116. To release the key lock 102, the wedge carrier 110 is first pushed in with key 106 and then allowed to move forward to its forwardmost position under the force of coil spring 122. The release of wedge carrier 110 is effected through the interaction of the transverse portion 124 and the guide track 116 in the same manner as described in reference to carrier 16 and transverse portion 70.

With carriers 16 and 16*a* in the locked position, as the wedge carrier 110 moves into the locked position, the wedge 112 forces locking pins 136 and 138 into engagement with the holes 140 in the carriers 16 and 16*a* respectively. With the wedge carrier 110 in the locked position, locking pins 136 and 138 protrude into the holes 140 and act to retain the carriers 16 and 16*a* in the locked position. When the wedge carrier 110 is released, the locking pins 136 and 138 move out of the holes 140 under the influence of the respective biasing springs 132 and 134. The top and bottom sockets can then be unlocked in the normal manner described with respect to the top socket above.

Figure 10:
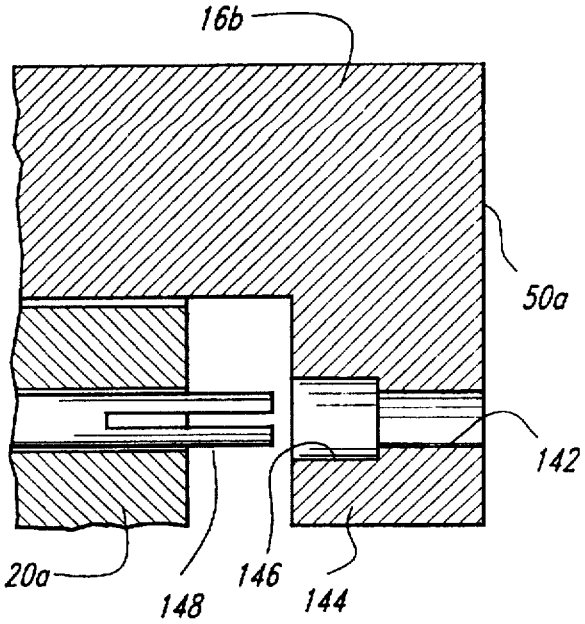
FIG. 10 is a fragmentary cross sectional view showing the relationship between the carrier and the ground contact of the present invention for plugs of the three prong type.

Referring to FIGS. 6, 7, 8, and 10, a version of the dual locking socket of the present invention for three prong plugs is shown. The embodiment of FIGS. 6–8 and 10 is identical in structure, function, and operation to the embodiment of FIGS. 1A, 1B, 2, 3, 4A, 4B, 5, 9, and 11, except for the differences noted below. First, the carriers 16 and 16*a* are replaced by carriers 16*b* and 16*c* respectively. The carriers 16*b* and 16*c* are identical to carriers 16 and 16*a*, except that the carriers 16*b* and 16*c* have enlarged faces 50*a* that have an additional hole 142 for receiving the ground prong of a three pronged plug. Referring to FIG. 10, the carriers 16*b* and 16*c* have an extended chin 144 behind the face 50*a* and around the hole 142. A recess 146 is provided behind the hole 142, into which the ground contact 148 telescopes. This feature helps ensure proper alignment between the hole 142 and the ground contact 148.

The base 20*a* differs from the base 20 in having a ground contact 148 which registers with the hole 142 of the carrier 16*b*. Conductor 150 and screw 152 allow the connection of the ground contact 148 to the building wiring. Also, the key operated lock 102 and the locking pins 136 and 138 are offset from the centerline of the base 20*a* such that the ground contact 148 of the top socket will not interfere with the locking pin 136. Naturally, the holes 140 are also offset from the centerline of the dual socket in an amount according to the offset of the locking pins 136 and 138. Note that if the wedge carrier 110 and the wedge 112 are sufficiently wide, the whole key operated lock 102 need not be moved. In such a case it may only be necessary to move the location of the locking pin 136 and the hole 140 of the top carrier 16*b* in order to accommodate the ground contact 148 of the top socket.

The final difference between the two prong and the three prong embodiments is that the housing 14*b* (see FIGS. 6 and 7) has a built up portion 154 extending below the housing 14*b*. The portion 154 houses the ground contact 148 of the bottom socket. The portion 154 would also have means similar to the conductor 150 and screw 152 for connecting the ground contact 148 of the bottom socket to the building wiring.

It should be kept in mind that the illustrated embodiments are provided as examples only. The guide grooves 100 and the guide rods 44 can be replaced by torsion springs extending between the jaws 36 and the carrier 16 to bias the jaws 36 toward the open position. Then as the carrier 16 is pushed in toward the locked position, the jaws 36 are forced to pivot toward the contacts 18 by the walls of the housing 14. Also, the key operated lock 102 can be replaced with an ordinary cylinder and tumbler lock operated by an ordinary key. In such a case, the lock cylinder could be provided with recesses that register with the locking pins 136 and 138 when the cylinder is in the unlocked position. As a key inserted in the lock cylinder is turned, the rotation of the lock cylinder cams the locking pins 136 and 138 out of the recesses in the lock cylinder and into engagement with the holes 140.

Figure 12:
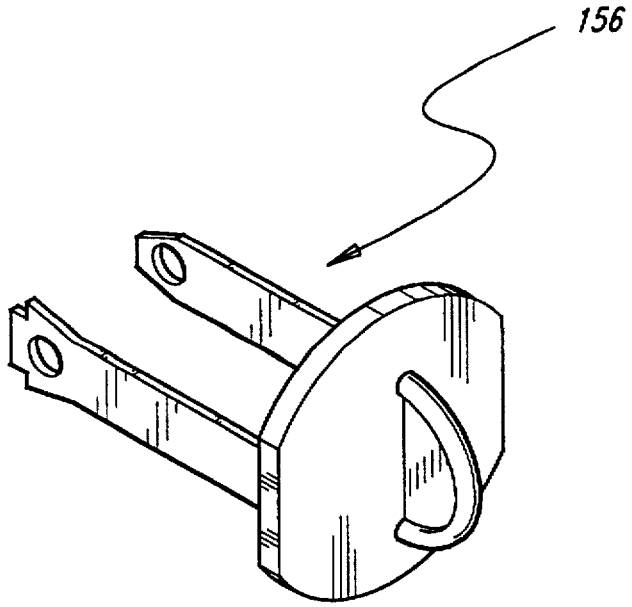
FIG. 12 is perspective view of the safety or dummy plug used with the locking socket of the present invention.

FIG. 12 shows a non-conductive safety or dummy plug 156, which can replace the standard plugs. With the dummy plug in place in a locked socket, children are prevented from inserting objects into the sockets. Thus, the locking sockets of the present invention are rendered far safer than ordinary sockets.

The dual locking sockets of the present invention can be secured within an opening in the wall of a building using any well known means. For example, brackets or flanges with screw holes could be secured to the housings 14, **14*a*, and 14*b*, or to the base 20 or 20*a*. Then the dual locking socket could be secured within an opening in the wall of a building in the same manner as a conventional socket. As with conventional sockets, a decorative face-plate or escutcheon fits over the dual locking socket to conceal the opening in the building wall once the dual locking socket is installed within the opening in the building wall. Preferably, the locking sockets of the present invention are dimensioned such that with the carriers 16, 16*a*, 16*b*, and 16*c* in the locked position, the faces 50 and 50*a* will be roughly flush with or slightly projecting from the decorative face-plate. The amount of the projection from the face-plate should be limited to the amount of travel between the locked position and the rearmost position of the carriers 16, 16*a*, 16*b*, and 16*c*. Also, the locking sockets of the present invention should be dimensioned such that with the carriers 16, 16*a*, 16*b*, and 16*c* in the unlocked position, the open sides of the carriers in the vicinity of the jaws 36** will not be exposed beyond the decorative side of the face-plate. In addition, the locking sockets of the present invention can be dimensioned such that they can replace existing conventional sockets without the need to modify the opening in the wall of the building or the decorative face-plate.

It is to be understood that the present invention is not limited to the embodiments described above, but encompasses any and all embodiments within the scope of the following claims.

I claim:

1. A locking socket for receiving an electrical plug having prongs, said locking socket comprising:

a carrier having a front face, said front face having openings for receiving selected ones of the prongs of the plug;

a housing receiving at least in part said carrier such that said front face is accessible for the purpose of insertion of the plug, said carrier being slidably movable relative to said housing between an unlocked position and a locked position, a greater portion of said carrier lying within a concavity defined at least in part by said housing when said carrier is in said locked position than when said carrier is in said unlocked position;

a conductive contact fixed relative to said housing, said conductive contact lying within said carrier, said carrier having a slot for allowing a support for said conductive contact to pass from without said carrier to within said carrier, said support being attached to said conductive contact, said support occupying only a portion of said slot such that said support will not interfere with at least slidable movement of said carrier between said locked position and said unlocked position; and a grasping jaw pivotably supported within said carrier, said grasping jaw being pivotable between a locked jaw position and an unlocked jaw position responsive to slidable movement of said carrier relative to said housing, said grasping jaw being in said locked jaw position when said carrier is in said locked position, said grasping jaw being in said unlocked jaw position when said carrier is in said unlocked position, whereby, when the selected ones of the prongs of the plug are inserted into said carrier and said carrier is in said locked position, at least one of the selected ones of the prongs of the plug is grasped between said grasping jaw and said conductive contact.

2. The locking socket according to claim 1, wherein said carrier is slidably movable between a rearmost position and said unlocked position, said locked position being intermediate said rearmost position and said unlocked position, said support occupying only a portion of said slot such that said support will not interfere with at least slidable movement of said carrier between said rearmost position and said unlocked position, said housing having a housing rear, said carrier having a carrier rear, said carrier rear lying within said concavity defined at least in part by said housing at all times, said locking socket further including:

a spring housing having a closed end, an open end and an interior, said spring housing being attached to said housing with said open end being attached to said housing rear and said interior of said spring housing being in communication with said concavity defined at least in part by said housing.

3. The locking socket according to claim 2, further including:

a platform attached to said carrier rear, said platform being in registry with said interior of said spring housing, said platform having a guide track formed therein; and a guide pin having an elongated portion and a transverse portion perpendicular to said elongated portion, said elongated portion having a first and a second end, said transverse portion being attached to said second end of said elongated portion, said first end of said elongated portion being attached to said closed end of said spring housing, said transverse portion engaging said guide track.

4. The locking socket according to claim 3, further including a coil spring located intermediate said carrier rear and said closed end of said spring housing, said coil spring biasing said carrier toward said unlocked position.

5. The locking socket according to claim 4, wherein said guide track is formed by a groove defining a closed circuit, said groove having a first ramp having first and second ends, a first step, a second step, and a second ramp having first and second ends, said second end of said second ramp being contiguous with said first end of said first ramp, said second step being surrounded in part by a V-shaped surface having a corner formed by two surfaces meeting at an acute angle, said corner being closer to said first end of said first ramp than said second end of said first ramp and said first end of said second ramp, said second end of said first ramp being higher than said first end of said first ramp, said first step being lower than and adjacent to said second end of said first ramp, said second step being lower than and adjacent to said first step, said first end of said second ramp being lower than and adjacent to said second step, said first end of said second ramp being lower than said second end of said second ramp, said first end of said first ramp being lower than and adjacent to said second end of said second ramp, whereby said transverse portion of said guide pin is positioned at about said corner of said V-shaped surface when said carrier is in said locked position, pushing said carrier from said locked position to said rearmost position causes said transverse portion of said guide pin to become positioned at about said first end of said second ramp, with said transverse portion of said guide pin positioned at about said first end of said second ramp releasing said carrier causes said coil spring to drive said carrier to said unlocked position thereby causing said transverse portion of said guide pin to become positioned at about said first end of said first ramp, pushing said carrier from said unlocked position to said rearmost position causes said transverse portion of said guide pin to become positioned on said first step, and with said transverse portion of said guide pin positioned on said first step releasing said carrier causes said coil spring to drive said carrier to said locked position thereby causing said transverse portion of said guide pin to become held by said corner of said V-shaped surface.

6. The locking socket according to claim 1, further including means for retaining said grasping jaw in said unlocked jaw position when said carrier is in said unlocked position.

7. The locking socket according to claim 6, wherein said carrier has an arcuate slot and said housing has a guide groove, said means for retaining said grasping jaw in the unlocked jaw position includes:

a guide rod attached to said grasping jaw and passing through said arcuate slot, said guide rod riding in said guide groove, said guide groove camming said grasping jaw into said unlocked jaw position when said carrier reaches said unlocked position, and said guide groove camming said grasping jaw into said locked jaw position when said carrier reaches said locked position.

8. The locking socket according to claim 1, further including a safety plug having at least one prong, said safety plug being made of an electrically insulating material, said safety plug being insertable in said locking socket such that said at least one prong of said safety plug is grasped between said grasping jaw and said conductive contact to thereby render said locking socket child proof.

9. A twin locking socket for receiving an electrical plug having prongs, said twin locking socket comprising:

a first locking socket including, a first carrier having a first front face, said first front face having first openings for receiving selected ones of the prongs of the plug;

a first housing receiving at least in part said first carrier such that said first front face is accessible for the purpose of insertion of the plug, said first carrier being slidably movable relative to said first housing between a first unlocked position and a first locked position, a greater portion of said first carrier lying within a first concavity defined at least in part by said first housing when said first carrier is in said first locked position than when said first carrier is in said first unlocked position;

a first conductive contact fixed relative to said first housing, said first conductive contact lying within said first carrier, said first carrier having a first slot for allowing a first support for said first conductive contact to pass from without said first carrier to within said first carrier, said first support being attached to said first conductive contact, said first support occupying only a portion of said first slot such that said first support will not interfere with at least slidable movement of said first carrier between said first locked position and said first unlocked position; and a first grasping jaw pivotably supported within said first carrier, said first grasping jaw being pivotable between a first locked jaw position and a first unlocked jaw position responsive to slidable movement of said first carrier relative to said first housing, said first grasping jaw being in said first locked jaw position when said first carrier is in said first locked position, said first grasping jaw being in said first unlocked jaw position when said first carrier is in said first unlocked position, whereby, when the selected ones of the prongs of the plug are inserted into said first carrier and said first carrier is in said first locked position, at least one of the selected ones of the prongs of the plug is grasped between said first grasping jaw and said first conductive contact; and a second locking socket including, a second carrier having a second front face, said second front face having second openings for receiving selected ones of the prongs of the plug;

a second housing receiving at least in part said second carrier such that said second front face is accessible for the purpose of insertion of the plug, said second carrier being slidably movable relative to said second housing between a second unlocked position and a second locked position, a greater portion of said second carrier lying within a second concavity defined at least in part by said second housing when said second carrier is in said second locked position than when said second carrier is in said second unlocked position;

a second conductive contact fixed relative to said second housing, said second conductive contact lying within said second carrier, said second carrier having a second slot for allowing a second support for said second conductive contact to pass from without said second carrier to within said second carrier, said second support being attached to said second conductive contact, said second support occupying only a portion of said second slot such that said second support will not interfere with at least slidable movement of said second carrier between said second locked position and said second unlocked position; and a second grasping jaw pivotably supported within said second carrier, said second grasping jaw being pivotable between a second locked jaw position and a second unlocked jaw position responsive to slidable movement of said second carrier relative to said second housing, said second grasping jaw being in said second locked jaw position when said second carrier is in said second locked position, said second grasping jaw being in said second unlocked jaw position when said second carrier is in said second unlocked position, whereby, when the selected ones of the prongs of the plug are inserted into said second carrier and said second carrier is in said second locked position, at least one of the selected ones of the prongs of the plug is grasped between said second grasping jaw and said second conductive contact.

10. The twin locking socket according to claim 9, further including:

a base having a front, a back, a top, and a bottom, said base supporting said first support for said first conductive contact and said second support for said second conductive contact, said first housing being fixedly attached to said top of said base, said second housing being fixedly attached to said bottom of said base, said base also having a lock cavity with an interior, an access hole in said front thereof, a first locking pin cavity, and a second locking pin cavity, said first locking pin cavity being located above said lock cavity and communicating therewith, said second locking pin cavity being located below said lock cavity and communicating therewith, said base also having a first pin channel and a second pin channel, said first pin channel allowing communication between said first locking pin cavity and said top of said base, said second pin channel allowing communication between said second locking pin cavity and said bottom of said base;

a first locking pin lying in part in said first pin channel, said first locking pin having a first end and a second end, said second end of said first locking pin being located within said first locking pin cavity, said second end of said first locking pin having a first spring stop means attached in proximity thereto;

a first locking pin spring extending between said first spring stop means and an end wall of said first locking pin cavity adjacent said first pin channel, said first locking pin spring biasing said first locking pin toward said interior of said lock cavity;

a second locking pin lying in part in said second pin channel, said second locking pin having a first end and a second end, said second end of said second locking pin being located within said second locking pin cavity, said second end of said second locking pin having a second spring stop means attached in proximity thereto;

a second locking pin spring extending between said second spring stop means and an end wall of said second locking pin cavity adjacent said second pin channel, said second locking pin spring biasing said second locking pin toward said interior of said lock cavity, said first carrier having a first locking pin hole which registers with said first locking pin when said first carrier is in said first locked position, said second carrier having a second locking pin hole which registers with said second locking pin when said second carrier is in said second locked position;

key operated camming means for selectively camming said first locking pin and said second locking pin into and out of engagement with said first locking pin hole and said second locking pin hole respectively; and a key for operating said key operated camming means, said access hole in said front of said base allowing said key to access said key operated camming means.

11. The twin locking socket according to claim 10, further including:

a first spring housing having a closed end, an open end and an interior, said first carrier having a first carrier rear, said first housing having a first housing rear, said first spring housing being attached to said first housing rear with said open end of said first spring housing being attached to said first housing rear and said interior of said first spring housing being in communication with said first concavity defined at least in part by said first housing;

a first platform attached to said first carrier rear, said first platform being in registry with said interior of said first spring housing, said first platform having a first guide track formed therein;

a first guide pin having a first elongated portion and a first transverse portion perpendicular to said first elongated portion, said first elongated portion having a first and a second end, said first transverse portion being attached to said second end of said first elongated portion, said first end of said first elongated portion being attached to said closed end of said first spring housing, said first transverse portion engaging said first guide track;

a first coil spring located intermediate said first carrier rear and said closed end of said first spring housing, said first coil spring biasing said first carrier toward said first unlocked position;

a second spring housing having a closed end, an open end and an interior, said second carrier having a second carrier rear, said second housing having a second housing rear, said second spring housing being attached to said second housing rear with said open end of said second spring housing being attached to said second housing rear and said interior of said second spring housing being in communication with said second concavity defined at least in part by said second housing;

a second platform attached to said second carrier rear, said second platform being in registry with said interior of said second spring housing, said second platform having a second guide track formed therein;

a second guide pin having a second elongated portion and a second transverse portion perpendicular to said second elongated portion, said second elongated portion having a first and a second end, said second transverse portion being attached to said second end of said second elongated portion, said first end of said second elongated portion being attached to said closed end of said second spring housing, said second transverse portion engaging said second guide track; and a second coil spring located intermediate said second carrier rear and said closed end of said second spring housing, said second coil spring biasing said second carrier toward said second unlocked position.

12. The twin locking socket according to claim 11, wherein said key operated camming means includes:

a key lock spring housing having a closed end, an open end and an interior, said key lock spring housing being attached to said back of said base with said open end being attached to said back of said base and said interior of said key lock spring housing being in communication with said lock cavity;

a wedge carrier slidably mounted in said lock cavity, said wedge carrier being movable between a third locked position and a third unlocked position, and said wedge carrier having a wedge, said wedge having an upper surface and a lower surface, said wedge carrier further having a wedge carrier rear;

a third platform attached to said wedge carrier rear, said third platform being in registry with said interior of said key lock spring housing, said third platform having a third guide track formed therein;

a third guide pin having a third elongated portion and a third transverse portion perpendicular to said third elongated portion, said third elongated portion having a first and a second end, said third transverse portion being attached to said second end of said third elongated portion, said first end of said third elongated portion being attached to said closed end of said key lock spring housing, said third transverse portion engaging said third guide track; and a third coil spring located intermediate said wedge carrier rear and said closed end of said key lock spring housing, said third coil spring biasing said wedge carrier toward said third unlocked position, said access hole having a first cross sectional shape, said key having a second cross sectional shape matching said first cross sectional shape such that said key is insertable through said access hole and is usable for imparting movement to said wedge carrier, whereby said first locking pin and said second locking pin are cammed into engagement with said first locking pin hole and said second locking pin hole respectively when said wedge carrier is in said third locked position, and said first locking pin and said second locking pin are allowed to disengage due to spring bias from said first locking pin hole and said second locking pin hole respectively when said wedge carrier is in said third unlocked position.

* * * * *